US010737858B1

(12) United States Patent
Hsu

(10) Patent No.: US 10,737,858 B1
(45) Date of Patent: Aug. 11, 2020

(54) ANTITHEFT DISPLAY ASSEMBLY FOR HAND TOOL

(71) Applicant: Huang-Tung Hsu, Taichung (TW)

(72) Inventor: Huang-Tung Hsu, Taichung (TW)

( * ) Notice: Subject to any disclaimer, the term of this patent is extended or adjusted under 35 U.S.C. 154(b) by 0 days.

(21) Appl. No.: 16/358,767

(22) Filed: Mar. 20, 2019

(51) Int. Cl.
*B65D 73/00* (2006.01)
*B25H 3/00* (2006.01)

(52) U.S. Cl.
CPC ..... *B65D 73/0064* (2013.01); *B25H 3/003* (2013.01); *B65D 2211/00* (2013.01)

(58) Field of Classification Search
CPC ... A47F 5/00; A47F 5/008; A47F 7/00; B25H 3/00; B25H 3/003; B25H 3/04; B65D 73/00; B65D 73/0064; B65D 85/00; B65D 85/20; B65D 85/28; B65D 2211/00
USPC ..... 206/378
See application file for complete search history.

(56) References Cited

U.S. PATENT DOCUMENTS 6,415,933 B1 * 7/2002 Kao ..... B25H 3/003 206/378
8,205,758 B2 * 6/2012 Shih ..... B25H 3/003 206/378
8,307,980 B1 * 11/2012 Kao ..... B25H 3/04 206/372
8,317,021 B2 * 11/2012 Christopher ..... B25H 3/003 206/234
8,381,905 B1 * 2/2013 Kao ..... B25H 3/003 206/1.5
8,550,244 B1 * 10/2013 Ou ..... B25H 3/04 206/378
8,875,884 B1 * 11/2014 Lee ..... B25H 3/04 206/1.5
9,572,437 B1 * 2/2017 Ou ..... B25H 3/003
2003/0070999 A1 * 4/2003 Kao ..... B25H 3/003 211/70.6
2003/0141211 A1 * 7/2003 Tsai ..... B25H 3/003 206/378
2010/0170817 A1 * 7/2010 Wu ..... B25H 3/003 206/378
2019/0014926 A1 * 1/2019 Chern ..... B65D 73/0064

* cited by examiner

*Primary Examiner* — Byron P Gehman
(74) *Attorney, Agent, or Firm* — Alan D. Kamrath; Karin L. Williams; Mayer & Williams PC

(57) ABSTRACT

An antitheft display assembly includes a support member, at least one hanging member mounted on the support member, at least one press member mounted on the at least one hanging member, at least one hand tool mounted on the at least one hanging member and locked by the at least one press member, and a limit member mounted on the support member. Thus, the at least one press member is isolated by the limit member and cannot be operated by anyone, while the locking block of the at least one press member is locked in one retaining groove of the at least one hand tool, such that the at least one hand tool is not detached from the at least one hanging member by pulling, thereby achieving an antitheft function.

4 Claims, 11 Drawing Sheets

ANTITHEFT DISPLAY ASSEMBLY FOR HAND TOOL

BACKGROUND OF THE INVENTION

1. Field of the Invention

The present invention relates to a tool display assembly and, more particularly, to an antitheft display assembly for a hand tool that is displayed or exhibited in a store or a mall.

2. Description of the Related Art

A conventional tool display assembly comprises a mounting bracket provided with a track, a plurality of hanging members pivotally mounted on the track of the mounting bracket, and a plurality of hand tools mounted on the hanging members. The mounting bracket is provided with a hanging hole. Each of the hanging members is provided with a mounting post, and each of the hand tools is provided with a slot mounted on the mounting post of each of the hanging members. Thus, the hanging hole of the mounting bracket is hung on an exhibition place to attract the consumer's attention, to facilitate the consumer selecting and purchasing the hand tools. However, the hand tools are easily removed from the hanging members, such that the conventional tool display assembly does not provide any burglarproof function during exhibition of the hand tools.

BRIEF SUMMARY OF THE INVENTION

The primary objective of the present invention is to provide an antitheft tool display assembly that provides a burglarproof function during exhibition of a hand tool, such as a socket and the like.

In accordance with the present invention, there is provided an antitheft display assembly comprising a support member, at least one hanging member mounted on the support member, at least one press member mounted on the at least one hanging member, at least one compression spring biased between the at least one press member and the at least one hanging member, at least one hand tool mounted on the at least one hanging member and locked by the at least one press member, and a limit member mounted on the support member and obstructing the at least one press member. The support member includes a main body, and a track mounted on the main body. The main body is provided with a hanging hole. The main body is provided with two locking holes located at two sides of the track. The at least one hanging member is provided with a slideway mounted on the track. The at least one hanging member is provided with a mounting post. The at least one hanging member is provided with a receiving chamber. The at least one hanging member has a periphery provided with two pivoting holes connected to the receiving chamber. The at least one press member is mounted in the receiving chamber of the at least one hanging member. The at least one press member has a first end provided with a press portion, and a second end provided with two pivot blocks. The two pivot blocks are pivotally mounted in the two pivoting holes of the at least one hanging member. The at least one press member is provided with a locking block. The at least one compression spring is mounted in the receiving chamber of the at least one hanging member. The at least one hand tool is provided with a slot mounted on the mounting post of the at least one hanging member. The slot of the at least one hand tool has a periphery provided with a plurality of retaining grooves, and the locking block of the at least one press member is locked in one of the retaining grooves of the at least one hand tool. The limit member includes a plank and two locking hooks mounted on two ends of the plank. The two locking hooks of the limit member are locked in the two locking holes of the support member.

According to the primary advantage of the present invention, the press portion of the at least one press member is isolated by the limit member and cannot be touched or operated by anyone, while the locking block of the at least one press member is locked in one of the retaining grooves of the at least one hand tool, such that the at least one hand tool is combined with and is not detached from the at least one hanging member by pulling of an external force, thereby achieving an antitheft function.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
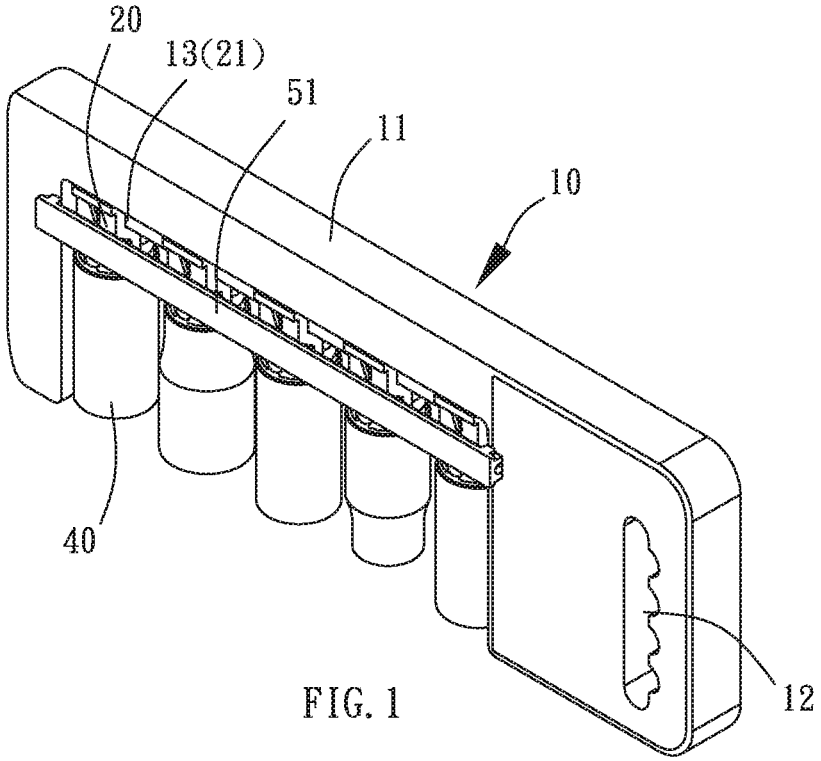
FIG. 1 is a perspective view of an antitheft display assembly in accordance with the preferred embodiment of the present invention.
Figure 2:
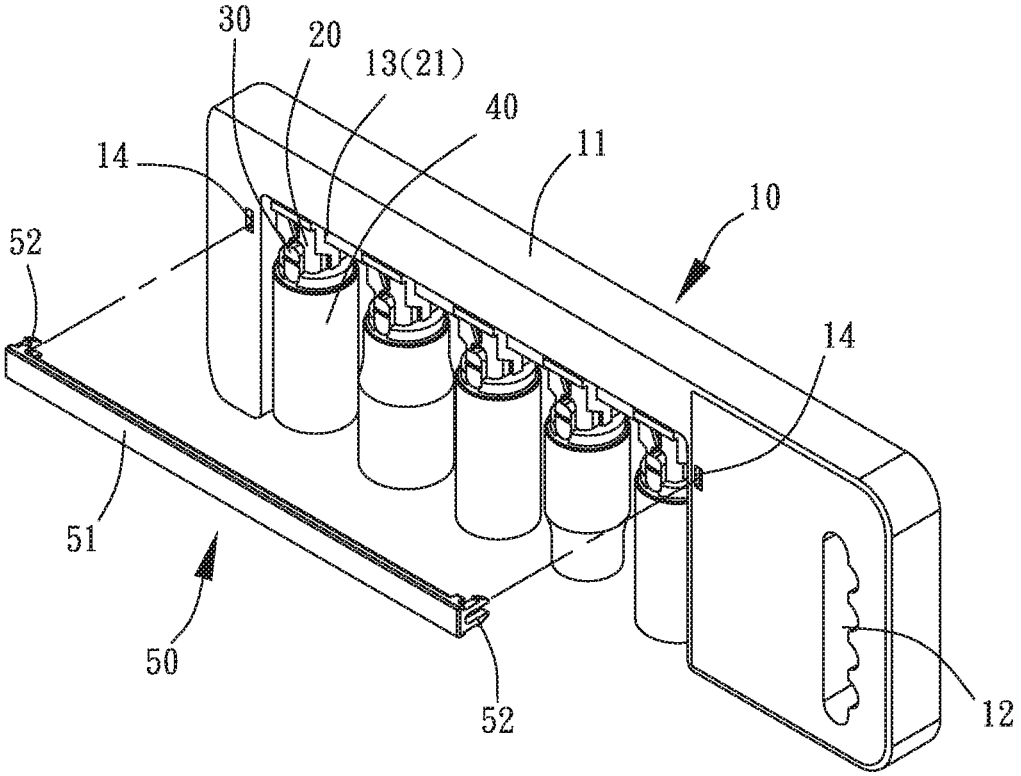
FIG. 2 is a partially exploded perspective view of the antitheft display assembly in accordance with the preferred embodiment of the present invention.
Figure 3:
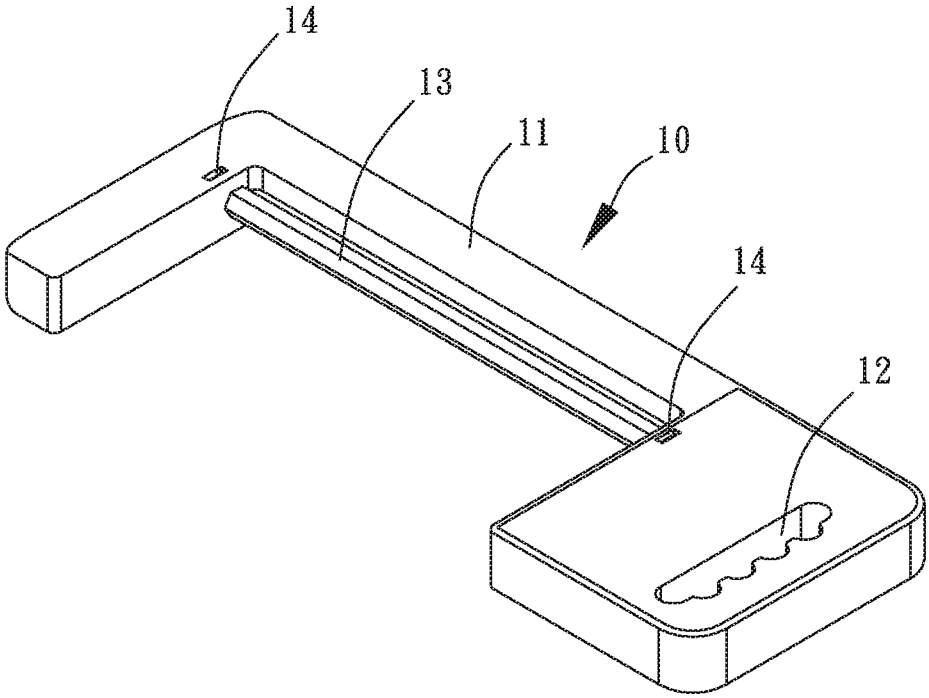
FIG. 3 is a perspective view of a support member of the antitheft display assembly in accordance with the preferred embodiment of the present invention.
Figure 4:
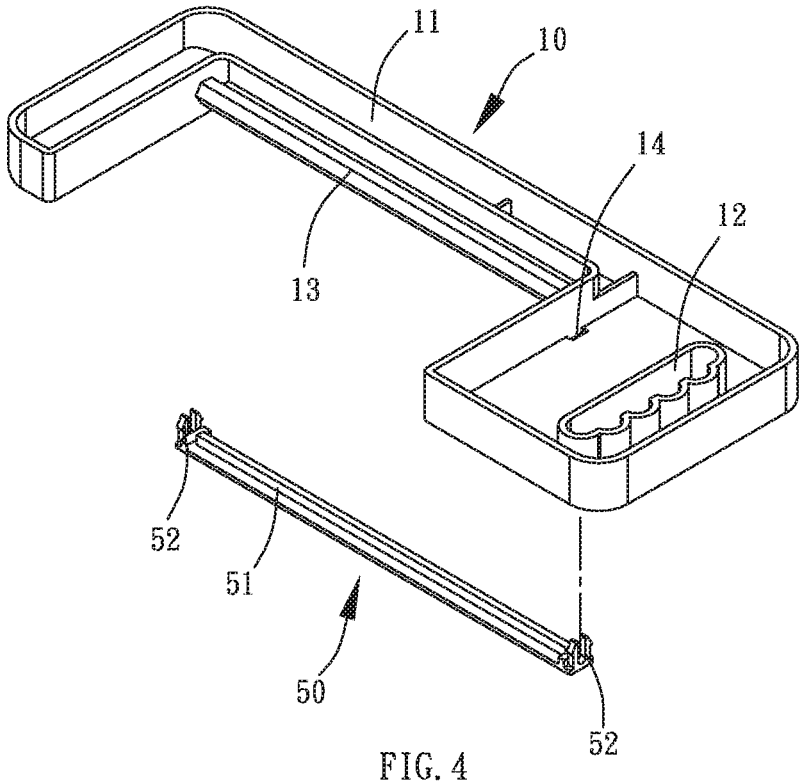
FIG. 4 is a partially exploded perspective view of the antitheft display assembly in accordance with the preferred embodiment of the present invention.
Figure 5:
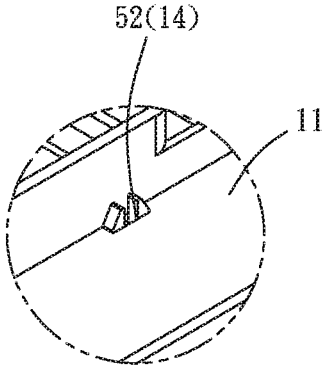
FIG. 5 is a locally enlarged perspective assembly view of the antitheft display assembly as shown in FIG. 4.
Figure 6:
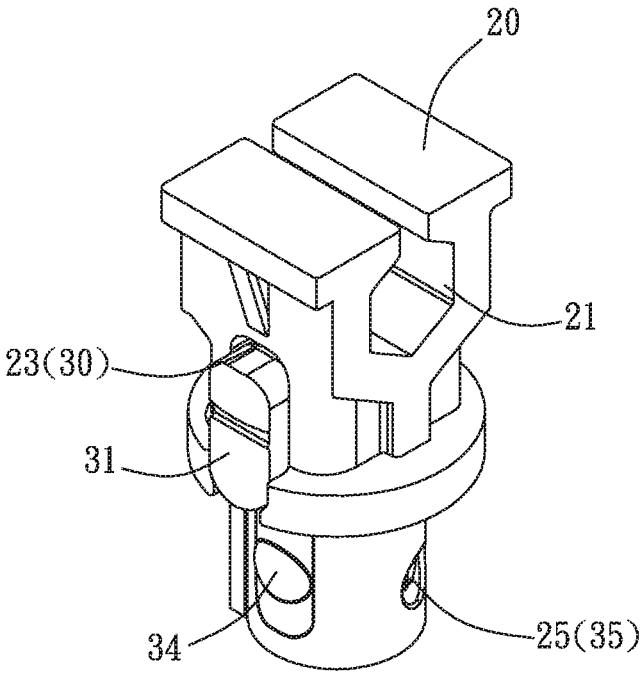
FIG. 6 is a partially perspective view of the antitheft display assembly in accordance with the preferred embodiment of the present invention.
Figure 7:
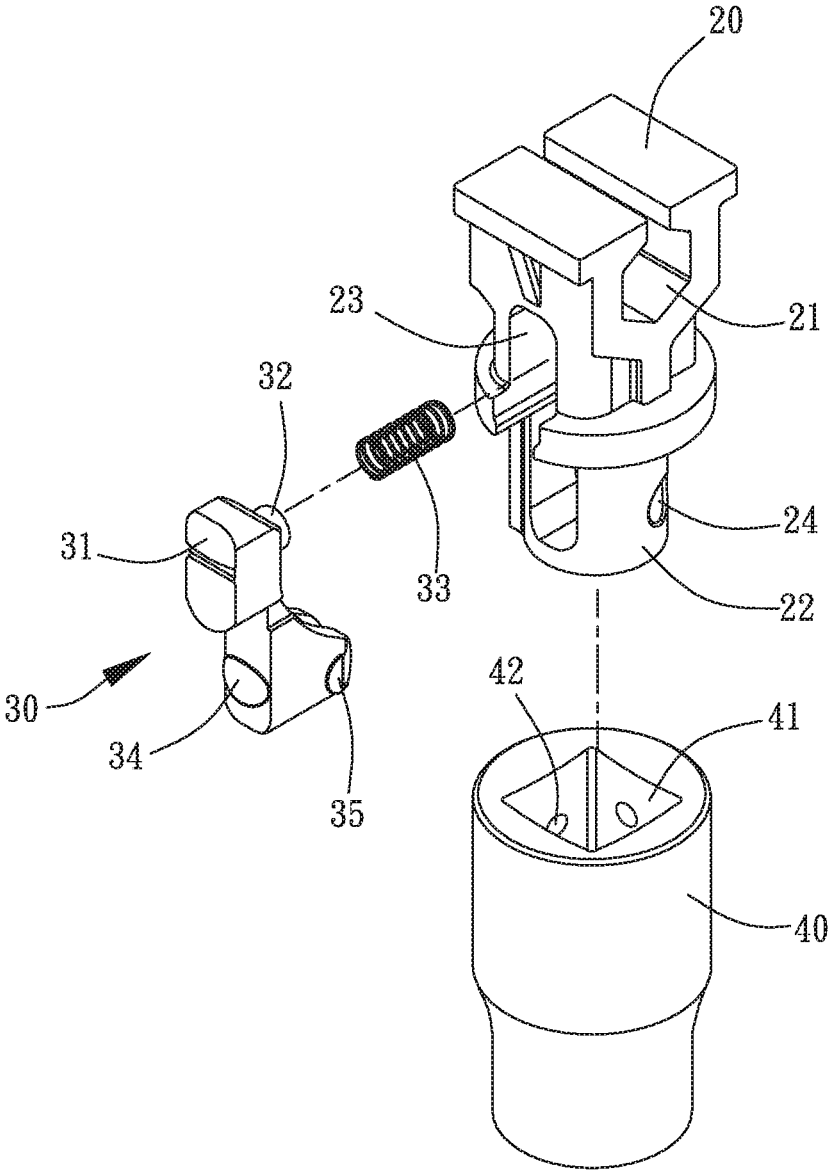
FIG. 7 is a partially exploded perspective view of the antitheft display assembly in accordance with the preferred embodiment of the present invention.
Figure 8:
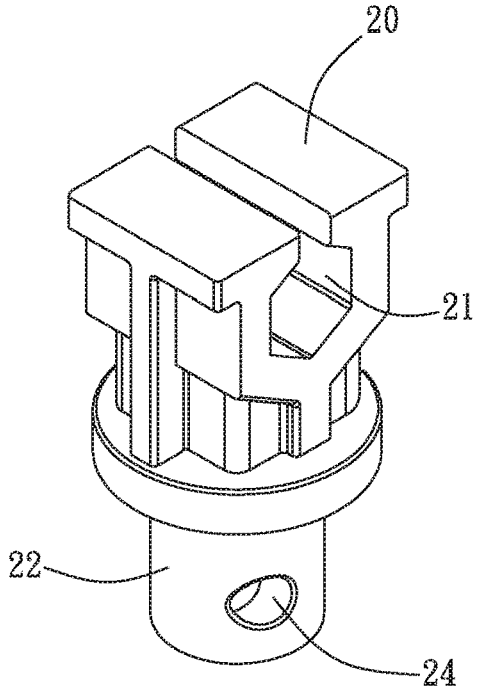
FIG. 8 is a perspective view of a hanging member of the antitheft display assembly in accordance with the preferred embodiment of the present invention.
Figure 9:
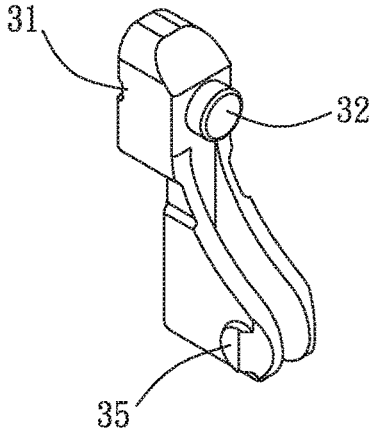
FIG. 9 is a perspective view of a press member of the antitheft display assembly in accordance with the preferred embodiment of the present invention.

Referring to the drawings and initially to FIGS. 1-11, an antitheft display assembly (or security pack or display packaging or display rack or tool hanger or stop lock or hanging lock) in accordance with the preferred embodiment of the present invention comprises a support member (or bracket or frame or rack or hanger) 10, at least one hanging member 20 mounted on the support member 10, at least one press (or fastening or locking or securing or restricting) member 30 mounted on the at least one hanging member 20, at least one compression spring 33 biased between the at least one press member 30 and the at least one hanging member 20, at least one hand tool 40 mounted on the at least one hanging member 20 and locked by the at least one press member 30, and a limit member 50 mounted on the support member 10 and obstructing (or covering) the at least one press member 30.

The support member 10 includes a main body 11, and a track 13 mounted on the main body 11. The main body 11 is provided with a hanging hole 12. The main body 11 is provided with two locking holes 14 located at two sides of the track 13.

The at least one hanging member 20 is provided with a slideway 21 slidably mounted on the track 13, such that the at least one hanging member 20 is moved transversely on the track 13 of the support member 10. The at least one hanging member 20 is provided with a mounting post (or column or insert or plug or stub or stud) 22 formed on a bottom thereof. The at least one hanging member 20 is provided with a receiving chamber 23. The at least one hanging member 20 has a periphery provided with two pivoting (or mounting or receiving) holes 24 connected to the receiving chamber 23.

The at least one press member 30 is movably mounted in the receiving chamber 23 of the at least one hanging member 20. The at least one press member 30 has a first end provided with a press portion 31, and a second end provided with two pivot blocks (or bosses or projections) 35. The two pivot blocks 35 are pivotally mounted in the two pivoting holes 24 of the at least one hanging member 20. The at least one press member 30 is provided with a locking block (or boss or projection) 34 which is located opposite to the two pivot blocks 35. The locking block 34 of the at least one press member 30 is formed on the second end of the at least one press member 30.

The at least one compression spring 33 is mounted in the receiving chamber 23 of the at least one hanging member 20 and is located opposite to the press portion 31.

The at least one hand tool 40 is provided with a slot 41 mounted on the mounting post 22 of the at least one hanging member 20. The slot 41 of the at least one hand tool 40 has a periphery provided with a plurality of retaining grooves 42, and the locking block 34 of the at least one press member 30 is locked in one of the retaining grooves 42 of the at least one hand tool 40. Preferably, the at least one hand tool 40 is a socket.

The limit member 50 includes a plank (or board or plate or bar) 51 and two locking hooks 52 mounted on two ends of the plank 51. The plank 51 of the limit member 50 faces the press portion 31 of the at least one press member 30. The two locking hooks 52 of the limit member 50 are locked in the two locking holes 14 of the support member 10.

In the preferred embodiment of the present invention, the first end of the at least one press member 30 is provided with a limit shaft 32 located opposite to the press portion 31, and the at least one compression spring 33 has a first end mounted on the limit shaft 32 and a second end pressing a side wall 25 of the receiving chamber 23.

In the preferred embodiment of the present invention, the press portion 31 is pivoted about the two pivot blocks 35 of the at least one press member 30 and the two pivoting holes 24 of the at least one hanging member 20, and is moved into the receiving chamber 23 to detach the locking block 34 of the at least one press member 30 from one of the retaining grooves 42 of the at least one hand tool 40.

In the preferred embodiment of the present invention, the plank 51 of the limit member 50 covers and seals the press portion 31 of the at least one press member 30 to prevent the press portion 31 of the at least one press member 30 from being pressed by an external force outside of the support member.

In assembly, the slideway 21 of the at least one hanging member 20 is mounted on the track 13 of the support member 10 from two ends of the track 13. Then, the track 13 of the support member 10 is combined with the main body 11 by injection molding. Thus, the at least one hanging member 20 is moved transversely on the track 13 of the support member 10. Then, the first end of the at least one compression spring 33 is mounted on the limit shaft 32. Then, the at least one press member 30 is mounted in the receiving chamber 23, with the second end of the at least one compression spring 33 pressing the side wall 25 of the receiving chamber 23. Then, the two pivot blocks 35 are pivotally mounted in the two pivoting holes 24. Then, the slot 41 of the at least one hand tool 40 is mounted on the mounting post 22 of the at least one hanging member 20, with the locking block 34 of the at least one press member 30 being locked in one of the retaining grooves 42 of the at least one hand tool 40. Then, the limit member 50 is mounted on the support member 10, with the two locking hooks 52 of the limit member 50 being locked in the two locking holes 14 of the support member 10, and with the plank 51 of the limit member 50 covering and sealing the press portion 31 of the at least one press member 30, to prevent the press portion 31 of the at least one press member 30 from being pressed by an external force.

Figure 10:
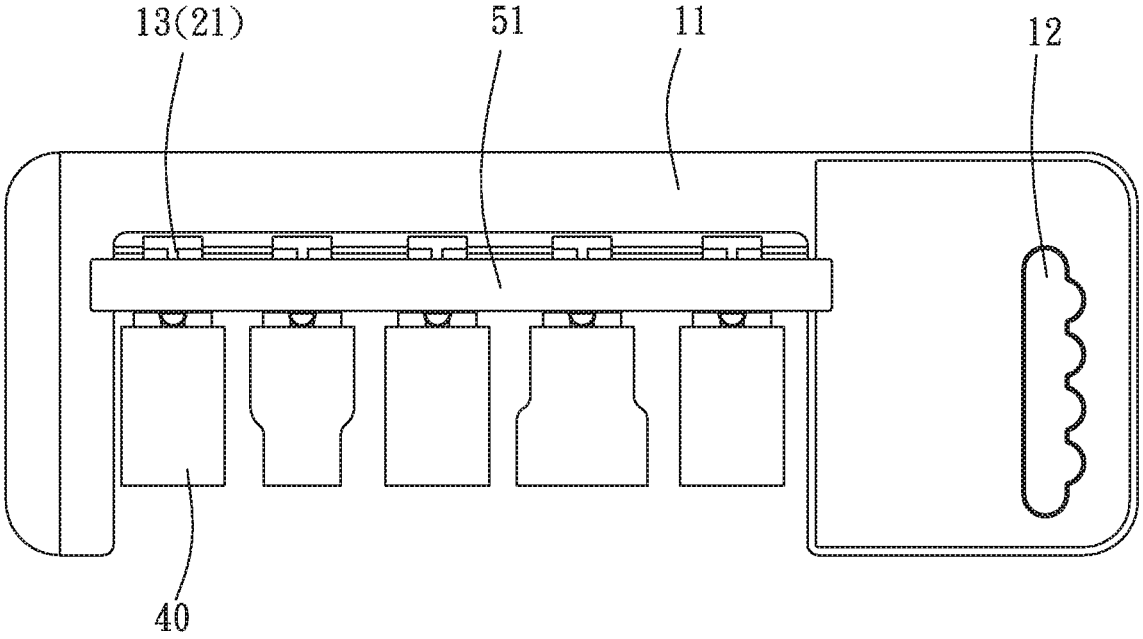
FIG. 10 is a front view of the antitheft display assembly as shown in FIG. 1.
Figure 11:
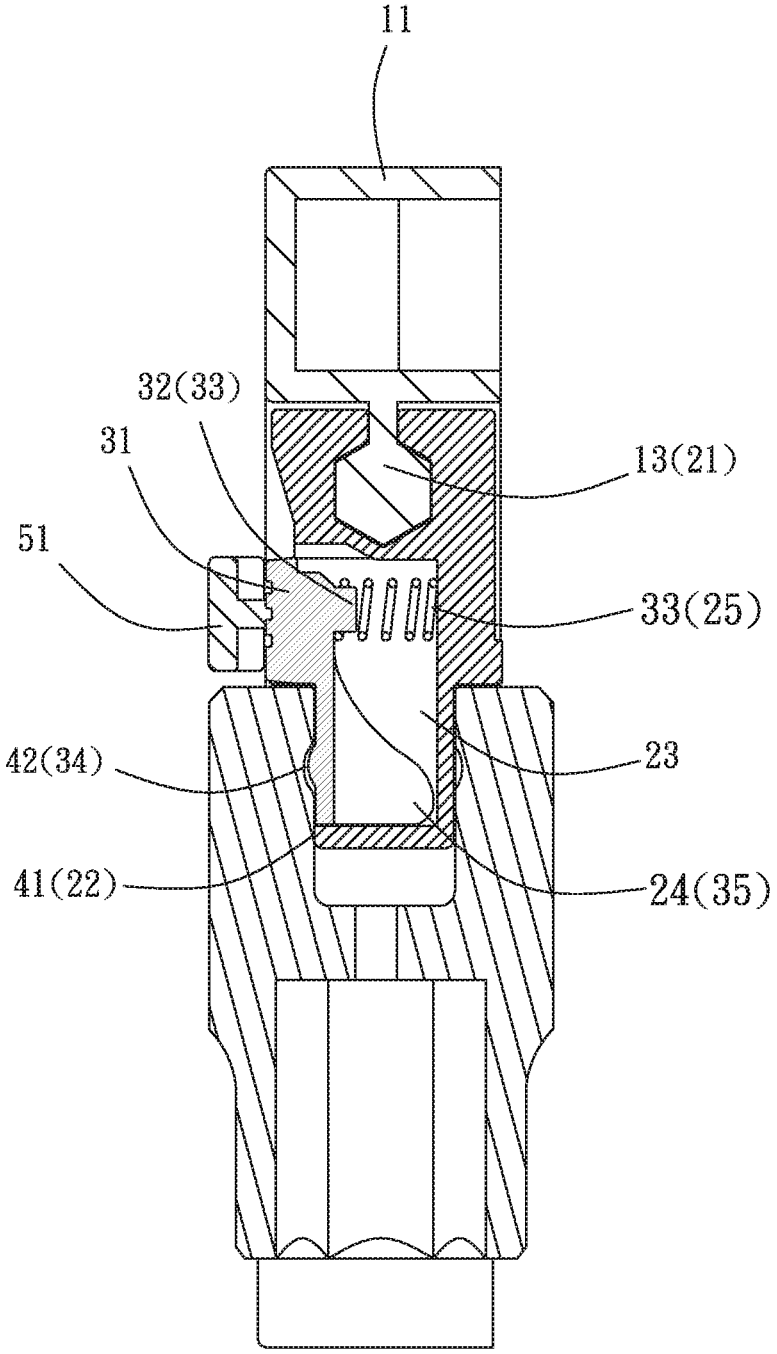
FIG. 11 is a side cross-sectional view of the antitheft display assembly as shown in FIG. 1.

In practice, referring to FIGS. 10 and 11 with reference to FIGS. 1-9, the hanging hole 12 of the support member 10 is hung on an exhibition place to attract the consumer's attention. At this time, the plank 51 of the limit member 50 obstructs the press portion 31 of the at least one press member 30, such that the press portion 31 of the at least one press member 30 is isolated by the limit member 50 and cannot be touched by anyone. At the same time, the locking block 34 of the at least one press member 30 is locked in one of the retaining grooves 42 of the at least one hand tool 40, such that the at least one hand tool 40 is secured to the at least one hanging member 20. In such a manner, when someone wishes to pull down the at least one hand tool 40, the at least one hand tool 40 is combined with and is not detached from the at least one hanging member 20 by an external force, thereby achieving an antitheft function.

Figure 12:
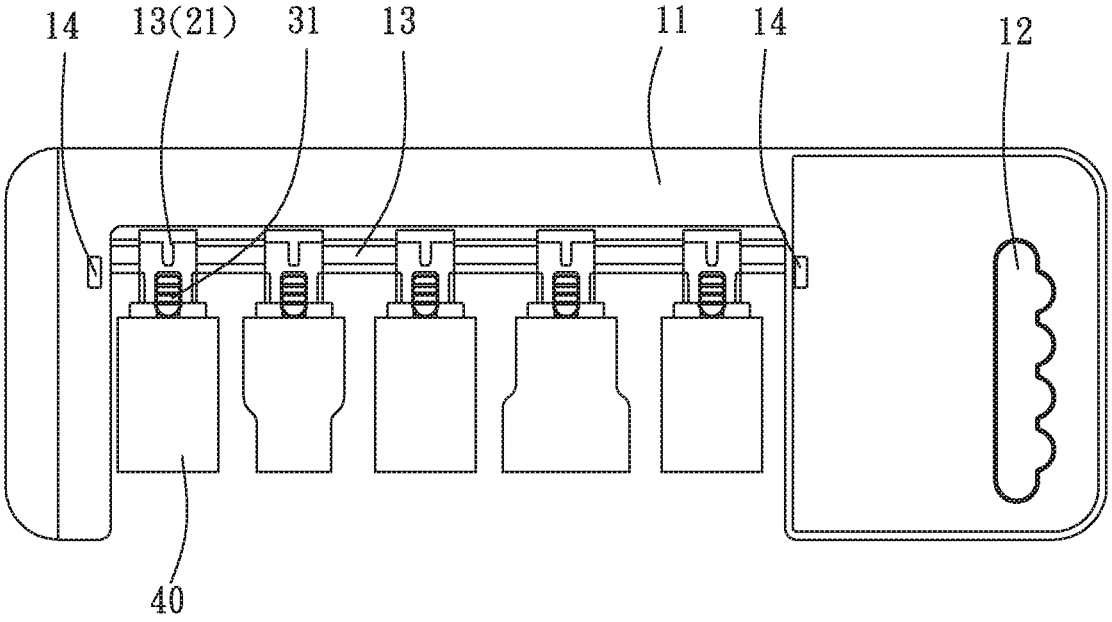
FIG. 12 is a front view showing the limit member is removed.
Figure 13:
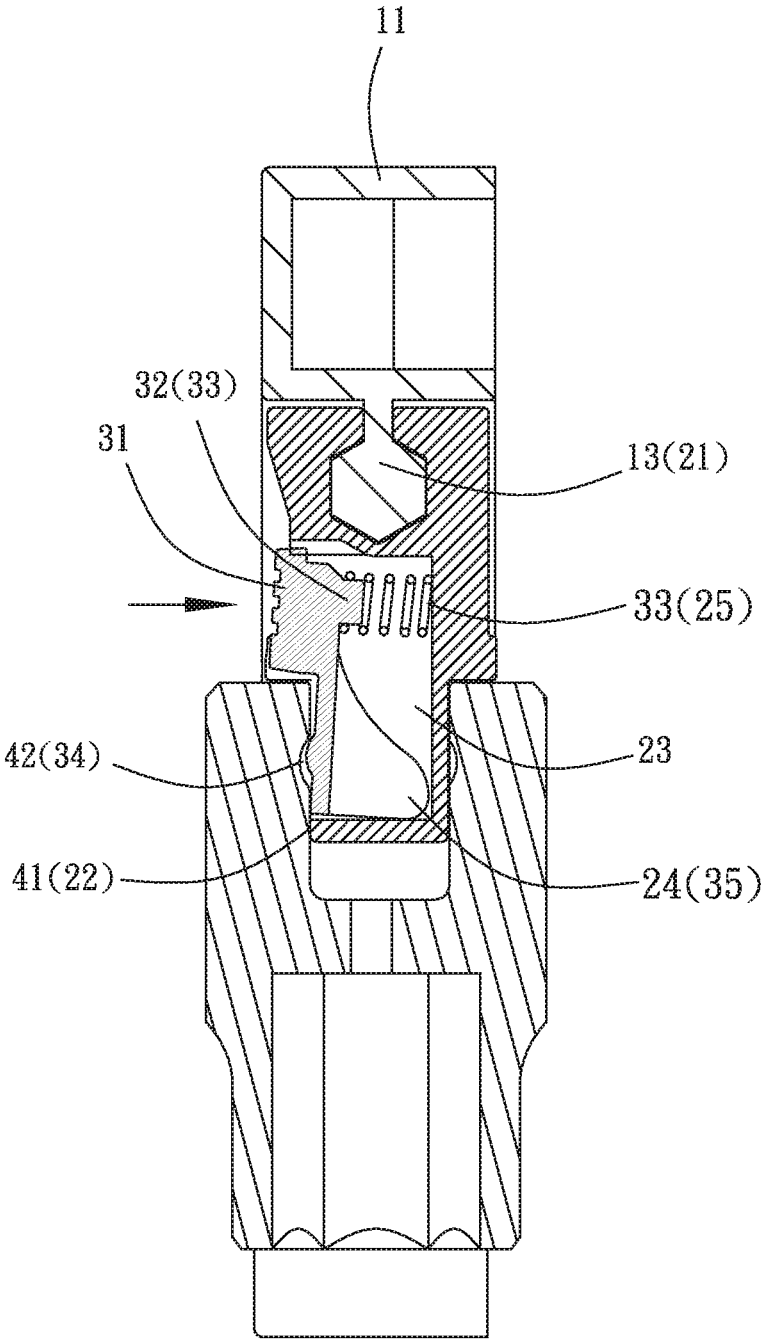
FIG. 13 is a schematic operational view of the antitheft display assembly as shown in FIG. 11.
Figure 14:
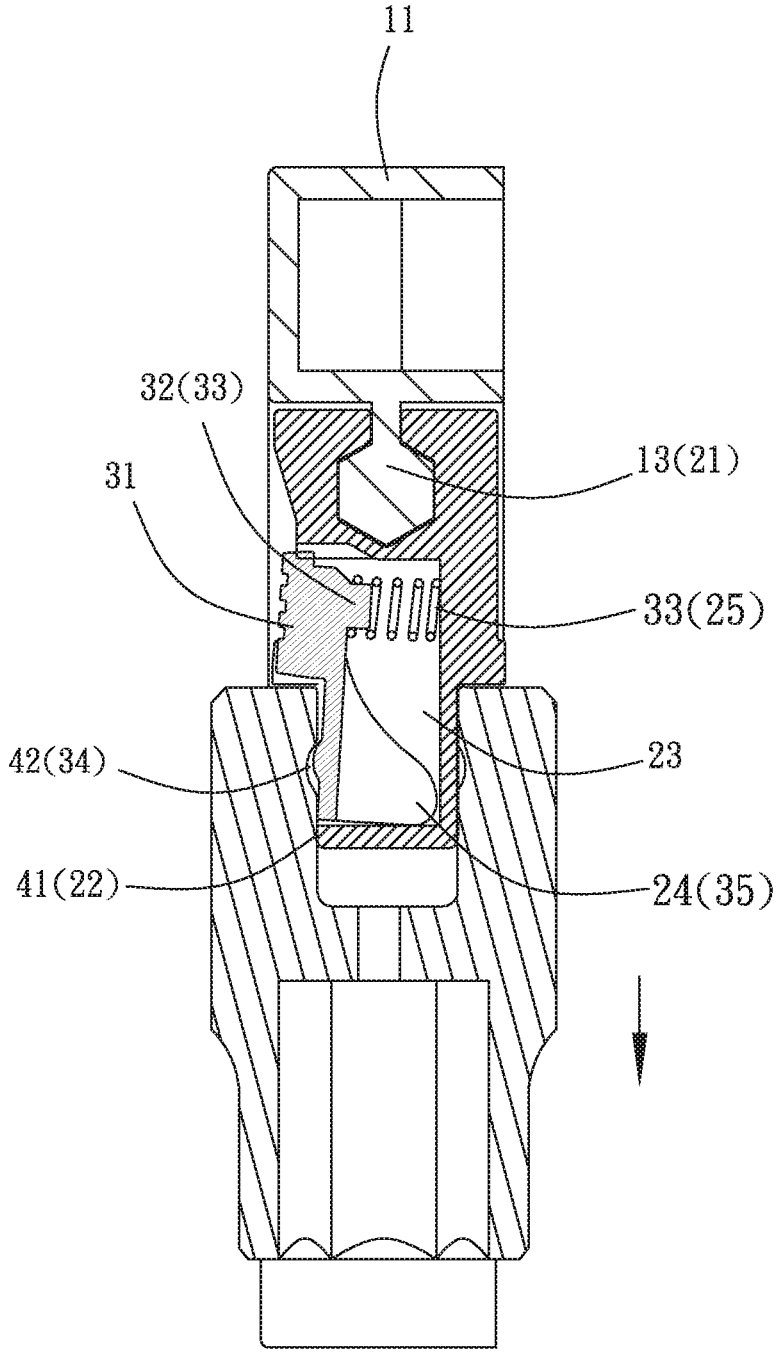
FIG. 14 is a schematic operational view of the antitheft display assembly as shown in FIG. 13.

Referring to FIGS. 12-14 with reference to FIGS. 1-11, when the antitheft display assembly is taken home, the two locking hooks 52 of the limit member 50 are cut and broken, and are unlocked from the two locking holes 14 of the support member 10, such that the limit member 50 is removed from the support member 10, and the press portion 31 of the at least one press member 30 is exposed outward as shown in FIG. 12. In such a manner, when the press portion 31 of the at least one press member 30 is pressed toward the at least one hanging member 20 as shown in FIG. 13, the at least one press member 30 is pivoted about the two pivot blocks 35 of the at least one press member 30 and the two pivoting holes 24 of the at least one hanging member 20, and is moved and retracted into the receiving chamber 23, such that the locking block 34 of the at least one press member 30 is detached from one of the retaining grooves 42 of the at least one hand tool 40. Thus, the at least one hand tool 40 is unlocked from the at least one press member 30, such that when the at least one hand tool 40 is pulled downward as shown in FIG. 14, the at least one hand tool 40 is removed from the mounting post 22 of the at least one hanging member 20 for use with the user.

When the user wishes to mount the at least one hand tool 40 on the at least one hanging member 20 again, the press portion 31 of the at least one press member 30 is pressed toward the at least one hanging member 20 to compress the at least one compression spring 33, such that the at least one press member 30 is pivoted about the two pivot blocks 35 of the at least one press member 30 and the two pivoting holes 24 of the at least one hanging member 20, and is moved and retracted into the receiving chamber 23. Then, the at least one hand tool 40 is mounted on the mounting post 22 of the at least one hanging member 20. When the press portion 31 of the at least one press member 30 is released, the at least one press member 30 is pivoted reversely by the restoring force of the at least one compression spring 33, such that the press portion 31 of the at least one press member 30 is returned to the original position, and the locking block 34 of the at least one press member 30 is inserted into and locked in one of the retaining grooves 42 of the at least one hand tool 40. Thus, the at least one hand tool 40 is locked by the at least one press member 30, and is secured to the mounting post 22 of the at least one hanging member 20, such that the at least one hand tool 40 is carried and stored easily and conveniently.

Accordingly, the press portion 31 of the at least one press member 30 is isolated by the limit member 50 and cannot be touched or operated by anyone, while the locking block 34 of the at least one press member 30 is locked in one of the retaining grooves 42 of the at least one hand tool 40, such that the at least one hand tool 40 is combined with and is not detached from the at least one hanging member 20 by pulling of an external force, thereby achieving an antitheft function.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An antitheft display assembly comprising:

a support member;

at least one hanging member mounted on the support member;

at least one press member mounted on the at least one hanging member;

at least one compression spring biased between the at least one press member and the at least one hanging member;

at least one hand tool mounted on the at least one hanging member and locked by the at least one press member; and a limit member mounted on the support member and obstructing the at least one press member;

wherein:

the support member includes a main body, and a track mounted on the main body;

the main body is provided with a hanging hole;

the main body is provided with two locking holes located at two sides of the track;

the at least one hanging member is provided with a slideway mounted on the track;

the at least one hanging member is provided with a mounting post;

the at least one hanging member is provided with a receiving chamber;

the at least one hanging member has a periphery provided with two pivoting holes connected to the receiving chamber;

the at least one press member is mounted in the receiving chamber of the at least one hanging member;

the at least one press member has a first end provided with a press portion, and a second end provided with two pivot blocks;

the two pivot blocks are pivotally mounted in the two pivoting holes of the at least one hanging member;

the at least one press member is provided with a locking block;

the at least one compression spring is mounted in the receiving chamber of the at least one hanging member;

the at least one hand tool is provided with a slot mounted on the mounting post of the at least one hanging member;

the slot of the at least one hand tool has a periphery provided with a plurality of retaining grooves;

the locking block of the at least one press member is locked in one of the retaining grooves of the at least one hand tool;

the limit member includes a plank and two locking hooks mounted on two ends of the plank; and the two locking hooks of the limit member are locked in the two locking holes of the support member.

2. The antitheft display assembly of claim 1, wherein the first end of the at least one press member is provided with a limit shaft located opposite to the press portion, and the at least one compression spring has a first end mounted on the limit shaft and a second end pressing a side wall of the receiving chamber.

3. The antitheft display assembly of claim 1, wherein the press portion is pivoted about the two pivot blocks of the at least one press member and the two pivoting holes of the at least one hanging member, and is moved into the receiving chamber.

4. The antitheft display assembly of claim 1, wherein the plank of the limit member covers and seals the press portion of the at least one press member to prevent the press portion of the at least one press member from being pressed outside of the support member.

* * * * *